US005176207A

United States Patent [19]

Keller

[11] Patent Number: 5,176,207

[45] Date of Patent: Jan. 5, 1993

[54] UNDERGROUND INSTRUMENTATION EMPLACEMENT SYSTEM

[75] Inventor: Carl E. Keller, Santa Fe, N. Mex.

[73] Assignee: Science & Engineering, Inc., Albuquerque, N. Mex.

[21] Appl. No.: 736,396

[22] Filed: Jul. 26, 1991

Related U.S. Application Data

[63] Continuation-in-part of Ser. No. 400,889, Aug. 30, 1989, abandoned.

[51] Int. Cl.[5] ..... E21B 23/08; E21B 47/06; E21B 49/10

[52] U.S. Cl. ..... 166/64; 166/72; 166/250; 166/264; 166/384; 166/385

[58] Field of Search ..... 166/100, 250, 264, 255, 166/254, 385, 387, 383, 64, 72, 77; 175/50, 249, 244-246; 405/133; 156/286, 294

[56] References Cited

U.S. PATENT DOCUMENTS

| | | | |
|---|---|---|---|
| 2,927,775 | 3/1966 | Hildebrandt | 175/245 X |
| 3,050,118 | 8/1962 | Elkins | 166/187 X |
| 3,500,819 | 3/1970 | Silverman | 156/29 X |
| 3,525,329 | 8/1970 | Zeimer | 128/262 |
| 3,589,356 | 9/1969 | Silverman | 604/27 X |
| 3,901,240 | 8/1975 | Hoey | 128/296 |
| 4,522,125 | 6/1985 | Marz | 166/63 X |

*Primary Examiner*—Stephen J. Novosad
*Attorney, Agent, or Firm*—James E. Snead

[57] ABSTRACT

A system for placing instrumentation within a hole enables a wide variety of instruments to be placed in the hole with enhanced measurement resolution and minimum risk of becoming lodged in the hole by partial collapse of the hole wall. A flexible tubular member is pressurized and averted from a canister into the hole, turning inside out as it extends into the hole. The application of pressure urges the tubular member against the hole wall in the manner of a hole liner or packer. A wide variety of instruments can be attached to the membrane and urged against the hole wall for measurement purposes. Typical measurements include temperature, pore fluid extraction and injection, in situ sensing with fiber optics, pore fluid pressure, and the like.

18 Claims, 3 Drawing Sheets

UNDERGROUND INSTRUMENTATION EMPLACEMENT SYSTEM

RELATED CASES

This case is a continuation-in-part of U.S. patent application Ser. No. 07/400,889, filed Aug. 30, 1989, now abandoned.

BACKGROUND OF INVENTION

This invention relates to instrumentation and analysis systems for use in holes within the earth, and, more particularly, to instrumentation and analysis systems for non-sliding and accurate emplacement of instruments and fluids within underground holes.

Holes are made in the earth for any number of reasons, including, e.g., oil and gas production, accessing below ground nuclear explosion sites, geological monitoring, and the like. It is frequently required to obtain information along the hole walls with accurate relationship to the location within the hole, whether the hole is vertical or horizontal. The information may be obtained from instrumentation such as thermocouples, pressure sensors, fiber optic sensors, and the like. Also, samples of fluids and geological structure may be needed.

There are two significant problems associated with obtaining information along hole walls: hole integrity and specimen availability. First, holes may be placed in weak or unconsolidated geological materials that is subject to collapse, with concomitant loss of equipment and loss of the hole. In conventional systems, instruments are simply "dragged" in and out of the hole along the outside of drill stems, pipes, wire lines, and the like, such that contact with the hole wall can result in damage to the hole.

Another problem is that of obtaining pore fluid and geological samples from hole locations where there is no fluid or movement of the specimens to be obtained. For example, contaminants such as gasoline or solvents will flow through the unsaturated surface soils and rock to the water table under the force of gravity and capillary action. There is no actual flow into the hole from which fluid may be obtained. Other applications may also require the extraction of specimens from hole wall locations.

Many applications require that the location of the sample be accurately known for correlation with geological strata and elevations (or travel distance) within the hole. In conventional sampling, hole fluid and soil samples are subject to being wiped along the hole wall. This action tends to spread contaminants along the wall, as well as to pick up materials from different elevations. It is then difficult to have an accurate determination of the location from which the sample was obtained.

These problems are addressed by the present invention and an improved system is provided for placing instruments and sensing and sampling materials along a hole wall.

Accordingly, it is an object of the present invention to place instruments along a hole wall without significant damage to the hole wall.

It is another object of the present invention to obtain sample materials from a hole wall by relatively passive means even in the absence of any fluid flow or collection of fluids.

Yet another object is to place instruments and obtain samples at accurately known locations.

Still another object is to prevent the contamination of samples obtained from the hole wall.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF INVENTION

To achieve the foregoing and other objects, and in accordance with the purposes of the present invention, as embodied and broadly described herein, the apparatus of this invention may comprise an instrument emplacement system for use in a hole with a substantially rigid wall. A flexible tubular member is extendable within the hole and inflatable to a diameter effective to urge the tubular member against the rigid wall. The tubular member has a proximal end and a distal end. A canister is connected to the proximal end for inflating and venting the tubular member. A handling means is provided within the housing for extending and retracting the tubular member. A tether connects the handling means and the distal end of the tubular member for withdrawing the distal end within the tubular member and inverting the tubular member. A vent is provided for equalizing pressure beneath the tubular member while retracting the member.

In another characterization of the present invention, an instrument emplacement is provided for use in a hole with a substantially rigid wall, including an inflatable flexible tubular member. A canister is provided for enclosing the tubular member. Fluid pressure means acts to extend the tubular member within the hole while turning the member inside out to form an inflated hole liner. At least one instrument is located on the outside of the member and is urged toward the hole wall. The instrument may be effective for temperature measurement, pressure measurement, fluid absorption, fluid extraction, fluid insertion, or fiber optic sensing.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Figure 1:
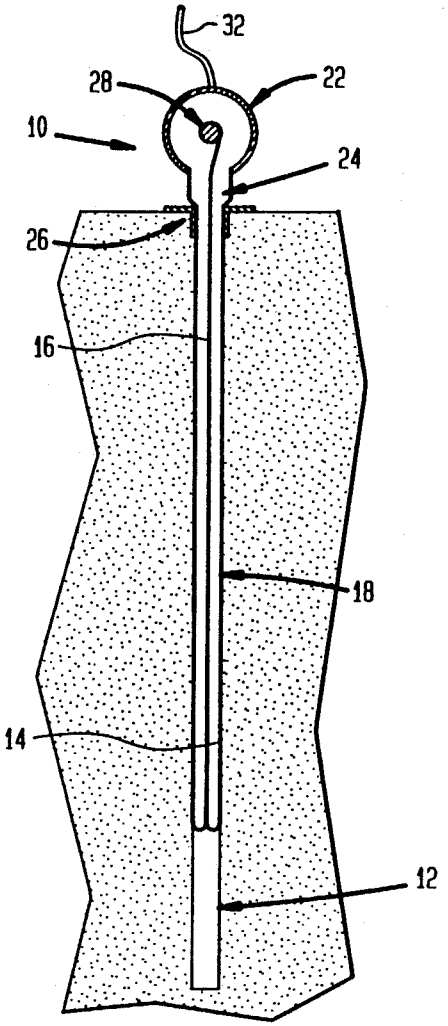
FIG. 1 is a cross-sectional view of one embodiment of the present invention with a tubular member fully extended into a hole.

Referring first to FIG. 1, there is shown a cross-sectional view of emplacement system 10, according to one embodiment of the present invention, with flexible tubing member 14 fully extended within hole 12. Tubular member 14 is constructed of a material that is impermeable to air and can be inflated, i.e., pressurized, to urge contacting surface 18 against the rigid walls that define hole 12. Exemplary materials include urethane, polyvinyl, coated nylon, fiberglass, and kevlar. Tubular member 14 is closed at the proximal end by canister 22 and connected at the distal end to tether 16, and may be inserted from the surface above hole 12 by base pipe 24 through hole collar 26.

For insertion into hole 12, tubular member may be initially wound onto handling means 28, e.g., a storage reel. A pressurizing fluid, in liquid or gas form, is introduced through line 32 within canister 22. As canister 22 is pressurized, tubular member 14 unwinds from reel 28 and extends within hole 12. It will be appreciated that contacting surface 18 of tubular member 14 does not slide along the side of hole 12, but rather unrolls along the sides as tubular member 14 everts onto hole 12. When tubular member 14 is fully extended, the pressure within canister 22 and tubular member 14 can be further increased through pressure tube 32 to more strongly urge contacting surface 18 against the walls of hole 12.

As is more fully explained with reference to FIG. 3, contacting surface 18 may be covered, either partially or completely, with an absorbent material, such as a felted or foamed material, to provide for collecting fluid and/or particulate samples from along the walls. Instrumentation such as thermocouples, capillary tubes, optical fibers, or the like, may also be placed along contacting surface 18 and be unwound with tubular member 14 and thereafter urged into contact with the walls of hole 12. The application of pressure within tubular member 14 also acts to support the walls of hole 12 to prevent any sloughing of the walls that could entrap conventional tubing and downhole instrumentation.

Figure 2:
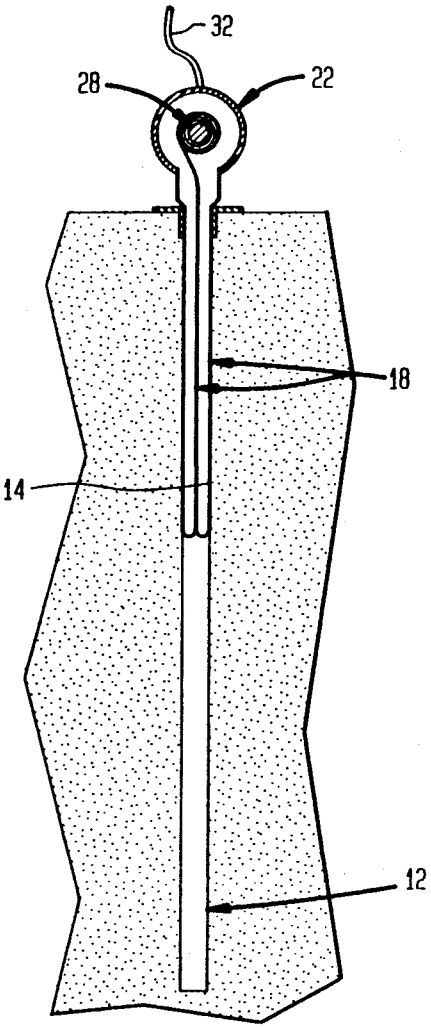
FIG. 2 is a cross-sectional view of the embodiment shown in FIG. 1 with the tubular member partially inverted during insertion or withdrawal from a hole.

Tubular member 14 is retracted within canister 22 as shown in cross-section by FIG. 2. Tether 16 (FIG. 1) connects reel 28 with the bottom of tubular member 14 Tether 16 may be hollow and vent through reel 28 so that the volume beneath tubular member 14 is vented to the atmosphere to prevent inducing a pressure or a vacuum as tubular member 14 is extended or retracted within hole 12. Alternately, a stationary venting tube (not shown) may be placed within hole 12 through hole collar 26 to a depth beneath extended tubular member 14 for venting the volume.

Pressure within canister 22 is now vented through tube 32 as tether 16 is wound onto reel 28, inverting contacting surface 18 for non-sliding removal from the wall of hole 12. Preferably, tube 32 includes some means of pressure regulation to maintain some positive pressure within tubular member 14, e.g., about 1 psi, while inverting tubular member 14 to further cause contacting surface 18 to resist sliding along the wall and provide support for the wall during retraction.

Contacting surface 18 is thus inverted as tether 16 is wound onto reel 28 and carries any instrumentation and absorbent materials within tubular member 14 and onto reel 28. Collecting surface 18 lies inside tubular member 14 and does not contact the wall surface during retraction within canister 22. There is no contamination of contacting surface 18 for wall sections that were not adjacent the extended tubular member 12. Also, the wall surfaces are not contaminated with materials from other hole wall surfaces. As tether 16 is wound onto reel 28, the rising inverting tubular member 12 causes a partial vacuum to develop in the volume beneath tubular member 12 that could cause the collapse of wall structure in hole 12 since the walls are rigid and can not otherwise compress to maintain pressure equalization. Tether 16 is hollow and vents the lower volume to the atmosphere for pressure equalization.

After tubular member 14 is wound onto reel 28, collection surfaces 18 are completely inverted. Canister 22 is then removed from hole collar 26 (FIG. 1) and taken to a location suitable for sample analysis. Outside the hole, the application of fluid pressure through tube 32 again pressurizes tubular member 14, causing tubular member 32 to unreel and evert outside canister 22. When tubular member 14 is fully extended, sample collection surfaces 18 are fully exposed for sample analysis. Where removable absorption panels are provided, they may be simply removed for laboratory analysis of the absorbed or adherent materials.

Figure 3:
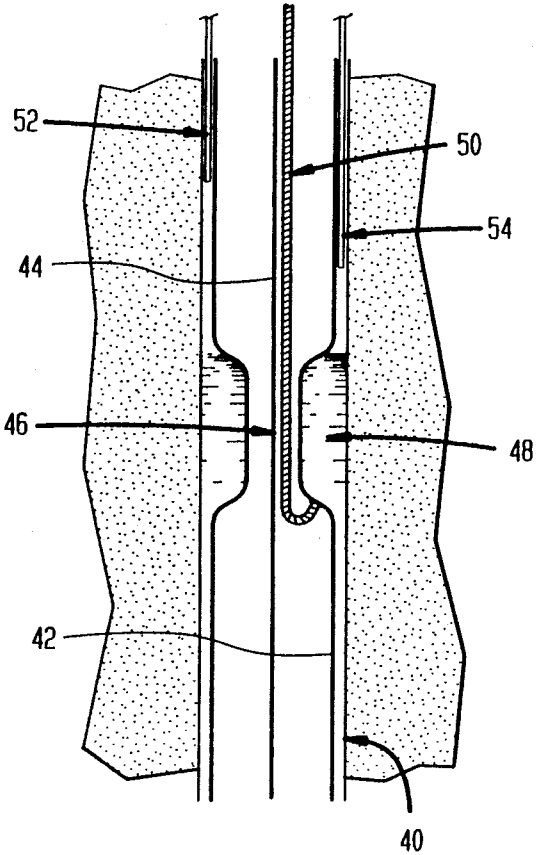
FIG. 3 is a cross-sectional view of the tubular member and illustrating instrumentation placement and fluid sampling.

Some of the capabilities of the instrument emplacement system according to the present invention are shown in FIG. 3. Flexible tubing member 42 is extended within hole 40 with the distal end connected to tether 44. A reduced diameter section 46 may be included along tubular member 42 to define a volume 48 that is connected to the surface through tube 50. In one embodiment, tube 50 acts to withdraw fluids from volume 48 to sample fluids percolating from the surrounding geological structure. In another embodiment, an absorbing material may be placed within volume 48 to sample fluids from the surrounding environment.

In yet another embodiment, tube 50 is used to inject a material, e.g., a tracer material to measure percolation to another location through the surrounding structure or a grout to seal the wall surrounding reduced diameter section 46. In these instances, the inflated tubular member 42 acts like a continuous packer to allow isolated sampling at selected locations within the hole 40 or to stabilize selected geological zones. It will be appreciated that the flexible tubular member 42 is easily recovered from around any sealing grout once the grout has set against the wall.

In yet another capability, an instrument wire 54 is attached to the outside of tubular member 42. Instrumentation such as thermocouples, pressure sensors, fiber optic sensors, and the like, then unroll with tubular member 42 for emplacement within hole 40 without sliding along the hole wall. Likewise, capillary tubing 52 may be attached to tubular member 42 for emplacement within hole 40. In both cases, the instruments are accurately placed within hole 40 and are easily removed when tubular member 42 is inverted during retraction. As noted above, an absorbent material may also be placed on the exterior of tubular member 42 and be urged against the wall of hole 40 by pressurizing tubular member 42.

In one prototype embodiment for testing in a six foot deep hole with a two inch i.d., the overall length of canister 22 (FIG. 1) was 14 inches and the total weight of the canister and tubular member was 5 lbs. With the membrane constructed of coated ripstop nylon, adding an additional 50 ft. of length would add only another pound of weight. Thus, a relatively small and lightweight device would be provided for sampling from within a 50 ft deep hole. There are no particular limitations on the size of the membrane and tubing lengths of 500–1000 ft for sampling from within holes having diameters of 8–10 ft (e.g., holes for use in sampling from weapons tests at the Nevada test site) are quite reasonable.

Figure 4C:
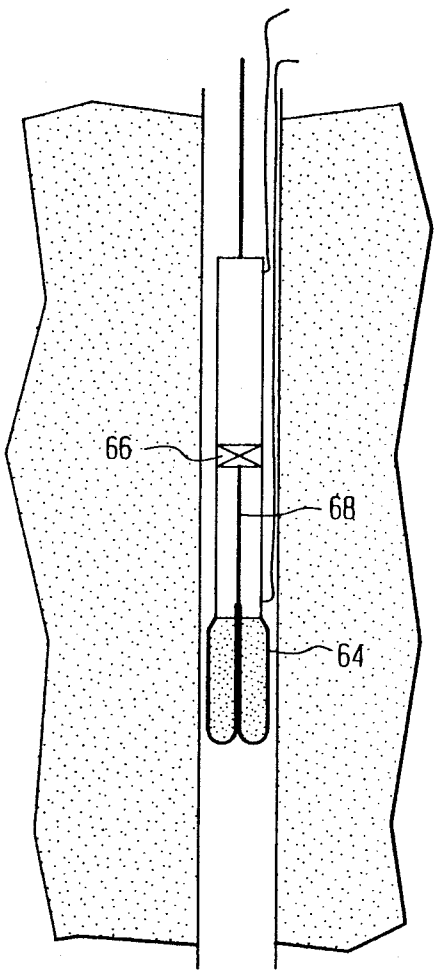
FIGS. 4A, 4B, and 4C are cross-sectional views of another embodiment of the present invention and illustrate tubular member insertion and withdrawal from a deep hole location.
Figure 4B:
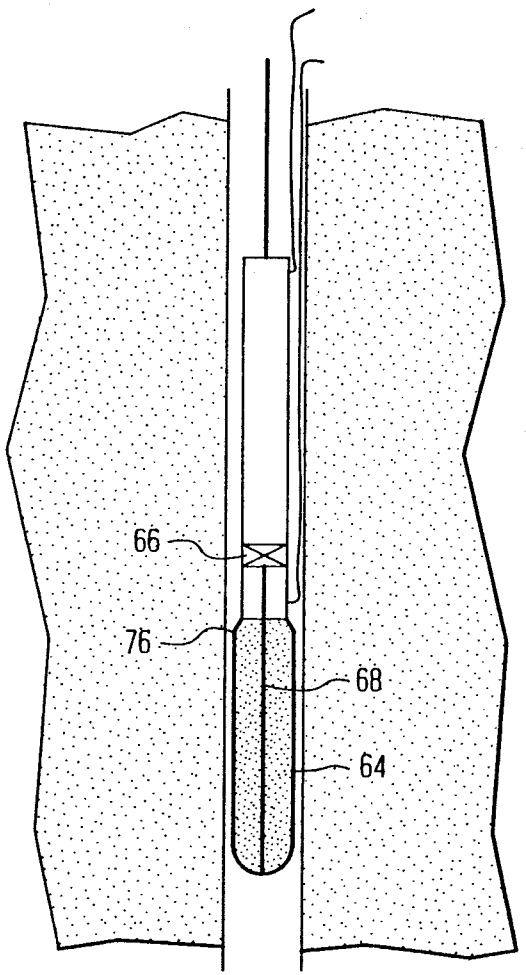
Figure 4A:
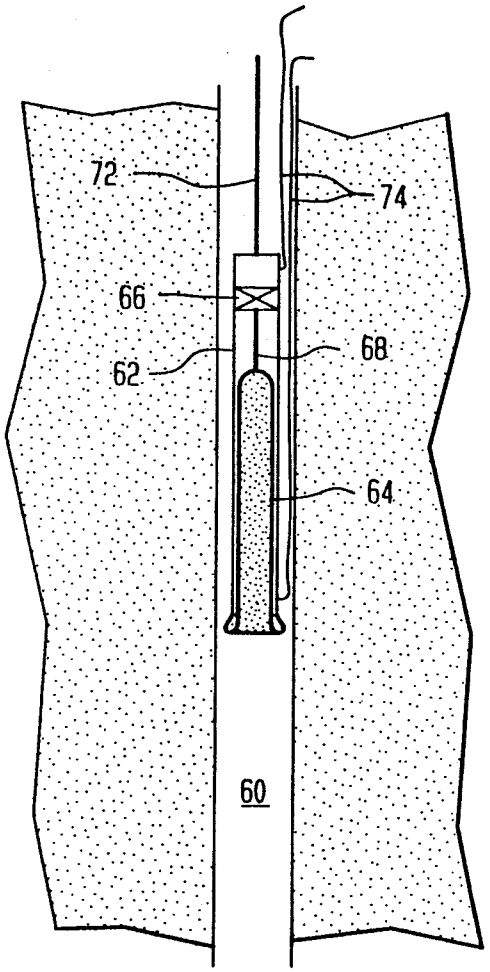

Referring now to FIGS. 4A, B, and C, there is shown another embodiment of an instrument emplacement system according to the present invention. The depicted embodiment is useful in deep hole environments, e.g., 2,000 ft and more. FIG. 4A illustrates the insertion of flexible tubular member 64 while withdrawn within transport tube or canister 62. Tether 68 connects tubular member 64 to piston 66, which is the handling means for the eversion and inversion of tubular member 64. Lines 74 may be alternately used to pressurize and vent the spaces above and below piston 66 to move transparent tube or canister 62 into and out of hole 60. Tether 68 is hollow for venting the hole volume below tubular member 64.

When the desired location is reached within hole 60, tubular member 64 is pressurized by the application of a pressurized fluid through the appropriate one of lines 74 to evert into hole 64 and apply instruments, absorption materials, and the like, as hereinabove discussed, adjacent the wall of hole 60. As shown in FIG. 4B, piston 66 moves down as tubular member 64 is everted. Instrumentation and fluid sampling and insertion may be provided as shown in FIG. 3.

After data collection is completed, the relative pressures above and below piston 66 are adjusted through lines 74 to cause piston 66 to rise within transport tube or canister 62. Tether 68 rises with piston 66 and inverts tubular member 64 within tube or canister 62. The entire assembly may then be removed to the surface and tubular member 64 again extended for sample analysis.

Figure 5A:
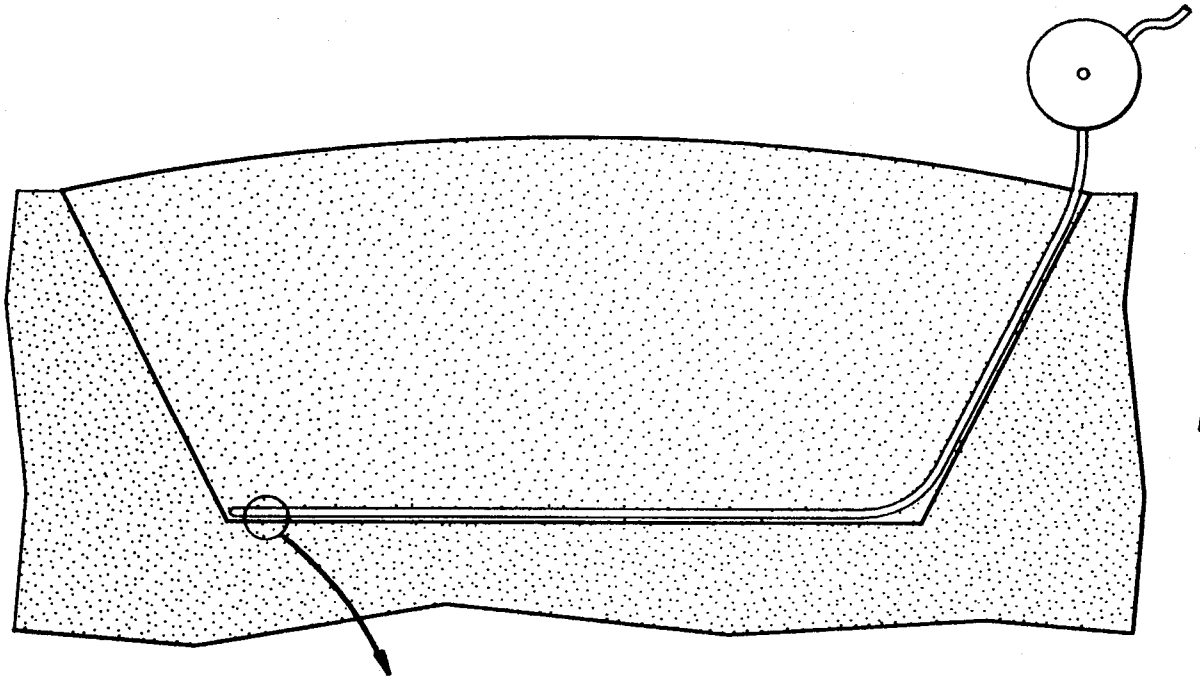
FIGS. 5A and 5B are cross-sectional views of a horizontal hole emplacement system according to the present invention.
Figure 5B:
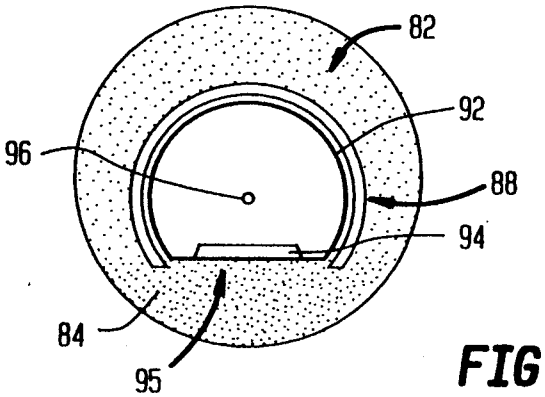

Referring now to FIGS. 5A and 5B, landfill 82 is placed within an excavation in the surrounding earth 84. A hole is formed along the interface of landfill 82 and earth 84 from rigid pipe sections, including surface pipe 86 and open pipe section 88, which may be substantially horizontal. Open pipe section 88 includes a rigid wall facing toward landfill 82 and an open 95 section facing surrounding earth 84.

Membrane 92, as hereinabove described, is extended through the hole defined by surface pipe 86 by introducing pressurized fluid through pipe 90. Membrane 92 extends into open pipe section 88 to sample fluids leaching from landfill 82 into surrounding earth 84. An absorbent collector 94, or other fluid collector or instrumentation described above, is placed in contact with surrounding earth 84 for sample and data collection. Tether 96 is connected to the end of membrane 92 to withdraw membrane 92 and absorbent pad 94, and the like, from beneath landfill 82 into canister 98 to provide an accurate survey of material leaching from landfill 82. A plurality of open pipe sections 88 may be provided to obtain a profile of materials leaching from landfill 82.

Thus, the instrument emplacement system herein described provides for both locating instruments and sample collection within a hole. The system also provides the capability of including reduced diameter sections for either in situ sampling of geological effluent or of injecting a grout or other material for stabilizing a portion of the hole wall at predetermined locations. The system may be used in vertical or horizontal holes, although in horizontal holes a relatively rigid pipe string may be required for inserting a transport canister, such as shown in FIG. 4, to remote locations within the hole. The system is inexpensive, simple, and easily transportable between a hole and an analysis laboratory for sample examination.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An instrument emplacement system for use in a hole in the earth with a substantially rigid wall, comprising:

a flexible tubular member extendable within said hole and inflatable to a diameter effective to urge said tubular member against said rigid wall and having a proximal end and a distal end;

canister means connected to said proximal end for inflating and venting said tubular member;

handling means within said canister means for extending and retracting said tubular member;

tether means connecting said canister means and said distal end of said tubular member for withdrawing said distal end within said canister means while inverting said tubular member; and means for venting from beneath said tubular member while retracting said member.

2. An instrument emplacement system according to claim 1, further including at least one instrument effective for urging toward said rigid wall of said hole by said flexible member.

3. An instrument emplacement system according to claim 2, wherein said at least one instrument is selected from the group consisting of a thermocouple, pressure sensing means, means for fluid extraction or absorption from said hole wall, and fiber optic sensing means.

4. An instrument emplacement system according to claim 1, wherein said flexible tubular member includes at least one section having a reduced diameter less than the diameter of said hole for capturing a fluid therebetween.

5. An instrument emplacement system according to claim 4, further including fluid line means connected to said reduced diameter section for removal or injection of said fluid.

6. An instrument emplacement system according to claim 1, wherein said canister means has a diameter effective for lowering within said hole to traverse long lengths of said hole.

7. An instrument emplacement system according to claim 6, wherein said canister means includes a piston means connected to said tether and movable within said canister to extend or retract said tubular member.

8. An instrument emplacement system according to claim 1, wherein said tubular member is formed from a material selected from the group consisting of urethane, polyvinyl, coated nylon, fiberglass, and kevlar.

9. An instrument emplacement system according to claim 8, wherein said tubular member includes an external covering of a foamed or felted material effective to absorb fluid and particulates while sealing against said hole rigid wall.

10. An instrument emplacement system according to claim 1, wherein said substantially rigid wall includes a pipe having an open section facing a portion of said earth to enable said tubular member to contact said earth.

11. An instrument emplacement system for use in a hole with a substantially rigid wall, comprising:

an inflatable flexible tubular member;

canister means for enclosing said tubular member;

fluid pressure means for extending said tubular member within said hole while turning said tubular member inside out to form an inflated hole liner; and at least one instrument on the exterior of said tubular member for urging toward said rigid wall and effective for temperature measurement, pressure measurement, fluid absorption, fluid extraction, fluid insertion, or fiber optic sensing.

12. An instrument emplacement system according to claim 11, wherein said flexible tubular member includes at least one section having a reduced diameter less than the diameter of said hole for capturing a fluid therebetween.

13. An instrument emplacement system according to claim 12, further including fluid line means connected to said reduced diameter section for removal or injection of said fluid.

14. An instrument emplacement system according to claim 11, wherein said canister means has a diameter effective for lowering within said hole to traverse long lengths of said hole.

15. An instrument emplacement system according to claim 14, wherein said canister means includes a piston means connected to said tether and movable within said canister to extend or retract said tubular member.

16. An instrument emplacement system according to claim 11, wherein said tubular member is formed from a material selected from the group consisting of urethane, polyvinyl, coated nylon, fiberglass, and kevlar.

17. An instrument emplacement system according to claim 16, wherein said tubular member includes an external covering of a foamed or felted material effective to absorb fluid and particulates while sealing against said hole rigid wall.

18. An instrument emplacement system according to claim 11, wherein said substantially rigid wall includes a pipe having an open section facing a portion of said earth to enable said tubular member to contact said earth.

* * * * *